US006982737B2

(12) United States Patent
Elko et al.

(10) Patent No.: US 6,982,737 B2
(45) Date of Patent: Jan. 3, 2006

(54) PRINTING METHOD AND APPARATUS

(75) Inventors: Paul P. Elko, River Hills, WI (US); Donald E. Brodnick, Cedarburg, WI (US)

(73) Assignee: GE Medical Systems Information Technologies, Inc., Milwaukee, WI (US)

( * ) Notice: Subject to any disclaimer, the term of this patent is extended or adjusted under 35 U.S.C. 154(b) by 934 days.

(21) Appl. No.: 09/681,229

(22) Filed: Mar. 1, 2001

(65) Prior Publication Data

US 2002/0122188 A1 Sep. 5, 2002

(51) Int. Cl.
*B41J 3/60* (2006.01)
*B41J 2/32* (2006.01)

(52) U.S. Cl. ..... 347/171

(58) Field of Classification Search ..... 347/171; 347/346/33 ME; 400/188, 613.2, 120.01; 400/600/523
See application file for complete search history.

(56) References Cited

U.S. PATENT DOCUMENTS 4,214,590 A * 7/1980 Patnoi et al. ..... 600/523
4,483,346 A * 11/1984 Slavin ..... 600/523
4,509,530 A * 4/1985 Curtis et al. ..... 600/523
4,900,001 A 2/1990 Lapeyre
5,456,539 A 10/1995 Wright et al.
5,558,449 A * 9/1996 Morgavi ..... 400/188
5,670,995 A 9/1997 Kupcho et al.
5,688,057 A * 11/1997 Wright et al. ..... 400/82
5,899,615 A 5/1999 Sansone

FOREIGN PATENT DOCUMENTS

DE 40 34 327 A1 4/1992
EP 0947340 * 10/1999
JP 58-5283 * 1/1983

* cited by examiner

*Primary Examiner*—Huan Tran
(74) *Attorney, Agent, or Firm*—Andrus, Sceales, Starke & Sawall, LLP

(57) ABSTRACT

An apparatus and method for printing on both sides of a medium by passing the medium through a printing device and printing on oppositely facing portions of the medium during a single pass of the medium through the printing device. Preferably, a first print head prints on one portion while a second print head prints on the other portion. The medium is preferably folded so that after the printing is completed and the folded medium is unfolded, the printed information on one portion of the medium correlates with the printed information on the other portion of the medium. The printed information is preferably data that has been measured with respect to time, and the printed data on the oppositely facing portions correlate with respect to time. Preferably, the data is medical patient data in the form of textual data, physiological waveforms, or a combination of both.

26 Claims, 3 Drawing Sheets

PRINTING METHOD AND APPARATUS

BACKGROUND OF INVENTION

Portable printing or writing devices, and more specifically, portable printing devices used in the medical field are known. Typically, portable printing devices are integrated in, or otherwise attached to portable medical devices used to monitor patient data, such as heart rate, blood pressure, blood oxygenation, respiration, brain activity, and the like. The printing devices enable the physician, nurse, medical technician or other healthcare worker (collectively "clinician") to print a hard copy of the patient data, which can be useful in studying and documenting changes in the patient's condition.

SUMMARY OF INVENTION

While it is desirable to reduce the size of portable medical components (e.g., electrocardiograph (ECG) units, defibrillators, monitors, and the like) there is a concern that reductions in printer size will hinder, and perhaps even impair the clinician's ability to quickly and accurately assess the printed patient data. A better understanding of this dilemma can be illustrated with the following example.

ECG units often include integral printers capable of printing data on standard 8.5×11 inch paper. The ECG output or report is typically printed in landscape format and includes textual patient data on the top one-third to one-fourth of the page and one or more waveforms (corresponding to measured patient data) on the bottom two-thirds to three-fourths of the page. The paper is often continuously supplied from a continuous fan-folded supply or a roll. Individual cut sheets can also be used.

In an effort to make portable ECG units smaller, and therefore more portable, the standard integral printers are sometimes replaced with smaller printers capable of printing on narrower strips of paper. These narrower strips are usually approximately four-and-one-quarter inches wide. Because it is not practical to simply reduce the size of the standard ECG report to fit on this narrower paper (from a practical standpoint, the smaller printout would be difficult and awkward to read, and from a technical standpoint, the standard waveform orientation produced by a 12-lead ECG unit would become severely distorted), it has been known to print the ECG report in halves. The first half printed includes the textual patient data and at least one waveform, both of which are normally found on the top half of a standard 8.5 inch wide report. The second half printed includes the remaining waveforms, which are normally found on the bottom half of a standard 8.5 inch wide report. Because the report must be printed in halves, the print time is double that of the print time for a standard 8.5×11 report.

After both halves have been printed, the health care provider must cut or tear the strip of paper between the first and second printed halves and realign the halves vertically (i.e., relative to a vertical reference line) to observe the time correlation of the data. This tearing and realigning process is burdensome and inaccurate and often involves taping or otherwise fastening the halves together. In yet another step, the two-piece report might be mounted on a separate backing.

The present invention overcomes this and other problems by providing an improved printing method and apparatus that promotes the use of smaller, more portable printing devices without sacrificing the speed, readability, or accuracy of the printout. More specifically, the invention provides a method of printing including passing a medium through a printing device and printing on oppositely facing portions of the medium during a single pass of the medium through the printing device. Preferably, printing on oppositely facing portions includes printing on one portion with a first print head and printing on the other portion with a second print head.

In one aspect of the invention, the medium is folded so that after the printing is completed and the folded medium is unfolded, the printed information on one portion of the medium correlates with the printed information on the other portion of the medium. In one embodiment, the printed information is data that has been measured with respect to time, and the printed data on the oppositely facing portions correlate with respect to time. Preferably, the data is medical patient data in the form of textual data, physiological waveforms, or a combination of both.

The invention also provides a printing device for printing on oppositely facing portions of a medium in a single pass. The printing device includes a feed path for receiving the medium, a first print head adjacent a first side of the feed path, and a second print head adjacent a second side of the feed path. In one embodiment, the print heads are thermal print heads.

In one aspect of the invention, the medium is folded and the feed path is sized to receive the folded medium. When folded, the medium is preferably approximately four to six inches wide. The feed path can include a separation member positioned between the oppositely facing portions of the folded medium. The first print head is configured to print data in a first orientation and the second print head is configured to print data in a second orientation. After printing, the medium can be unfolded and the data printed by the first print head correlates with the data printed by the second print head.

In another aspect of the invention, the printing device is coupled to a piece of medical equipment, such as an ECG unit, a defibrillator, a monitor, or the like. Data collected by the medical device, including physiological waveforms, can be printed by the printing device.

DETAILED DESCRIPTION

Figure 1:
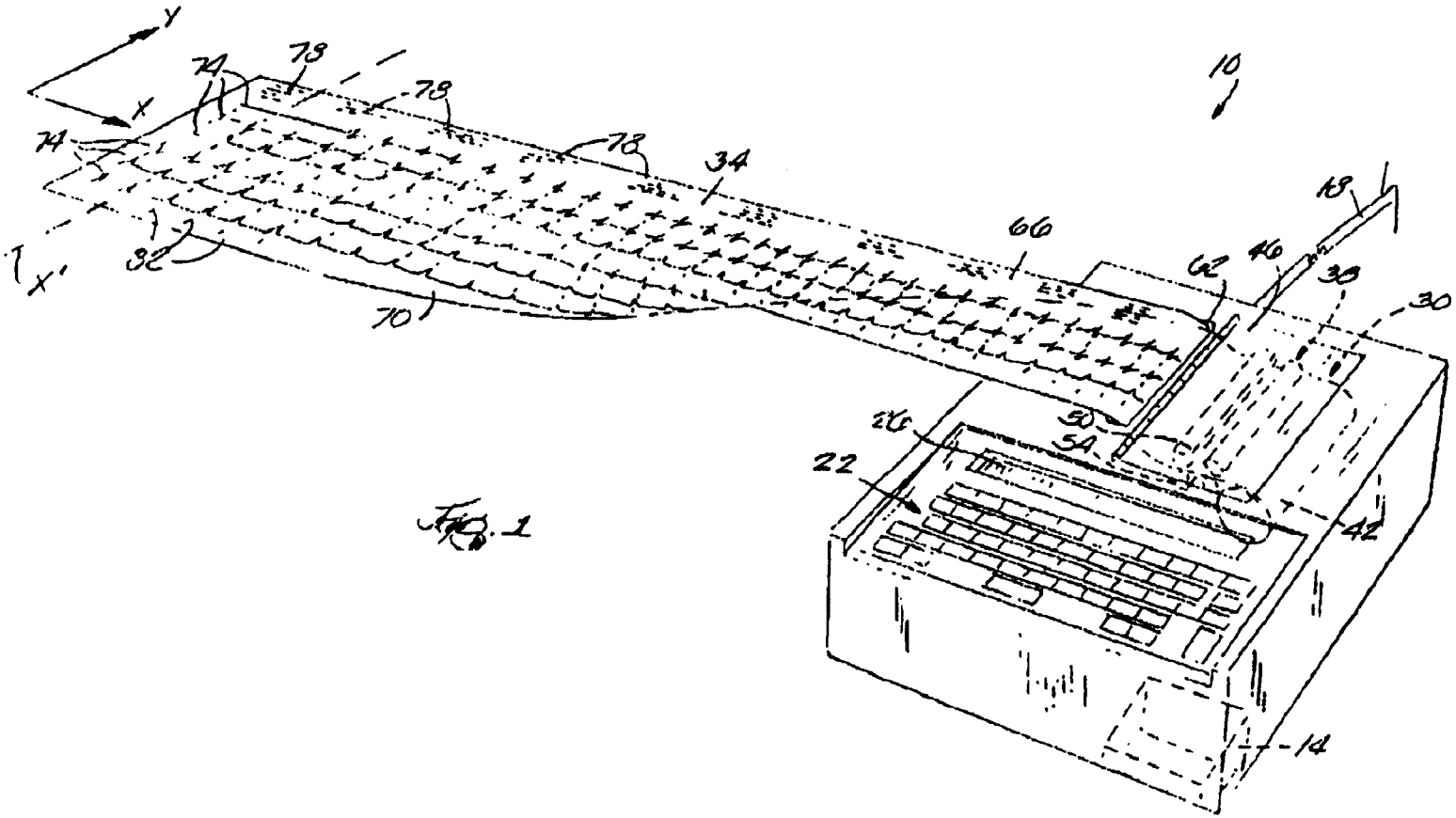
FIG. 1 is perspective view of a device embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

FIG. 1 illustrates a device 10 embodying the invention. In the illustrated embodiment, the device 10 is a portable 12-lead ECG unit, however, the device 10 could be any type of device (medical or non-medical, portable or stationary) used to print data. The device 10 includes a processor 14 (shown schematically in FIG. 1) that processes physiological data collected from a patient (not shown) via leads 18, as is commonly known in the art. The device 10 also includes an input device in the form of a keyboard 22. The keyboard 22 is used to input textual patient information such as the patient's name, age, sex, height, weight, and the like. A visual display 26 is located adjacent the keyboard 22 and, among other things, facilitates the input of patient information.

Figure 5:
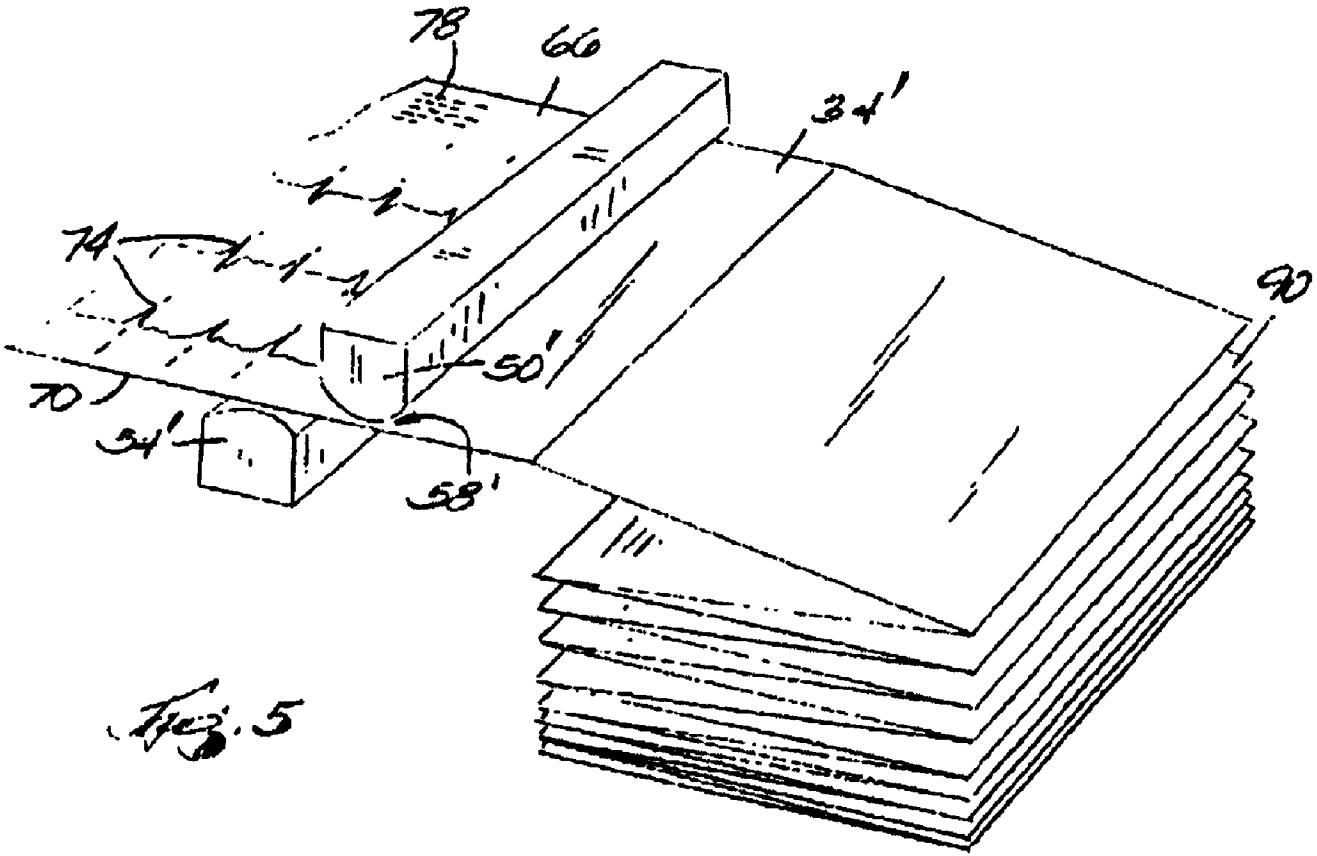
FIG. 5 is a perspective view similar to FIG. 2 showing an alternative print head configuration and paper supply.

The device 10 also includes an integral printing device 30 coupled to the processor 14 through a standard electronic communication link (not shown). The printing device 30 prints the physiological patient data and the textual patient information onto a printable medium, such as paper 34. Of course, the printing device 30 need not be integral with the device 10, but could be a separate unit coupled to the device 10 and the processor 14 via suitable connectors. The printing device 30 includes paper feed rollers 38 (shown in phantom in FIG. 1) or other suitable members that advance the paper 34 through the printing device 30. In the embodiment illustrated in FIGS. 1–4, the paper 34 is supplied from a roll 42, however, as will be described in more detail below, the paper 34 could also be supplied from a fan-folded stack or individual sheets as shown in FIG. 5. A hinged panel 46 on the device 10 provides access to the printing device 30 and the roll 42.

As seen in FIGS. 1–5, the printing device 30 includes first and second print heads 50 and 54, respectively. The print heads 50, 54 oppose one another and are spaced apart to define a feed path 58 through which the paper 34 advances during printing. Paper is advanced from the roll 42 by the feed rollers 38, passes through the feed path 58, and exits the device 10 through an aperture 62. While the print heads 50, 54 are shown to extend substantially horizontally inside the device 10, it is understood that the print heads 50, 54 could alternatively extend substantially vertically inside the device 10. Of course, if the orientation of the print heads 50, 54 is changed, the orientation of the feed rollers 38, the roll 42, and the aperture 62 may also be changed. In the preferred embodiment, the print heads 50, 54 are thermal print heads that print on thermally-sensitive paper, as is commonly known in the art, and the paper 34 is thermally-sensitive paper. Of course, other types of print heads, such as ink jet, ink pen, or laser print heads could also be used, in which case, the paper 34 need not be thermally-sensitive paper.

Figure 2:
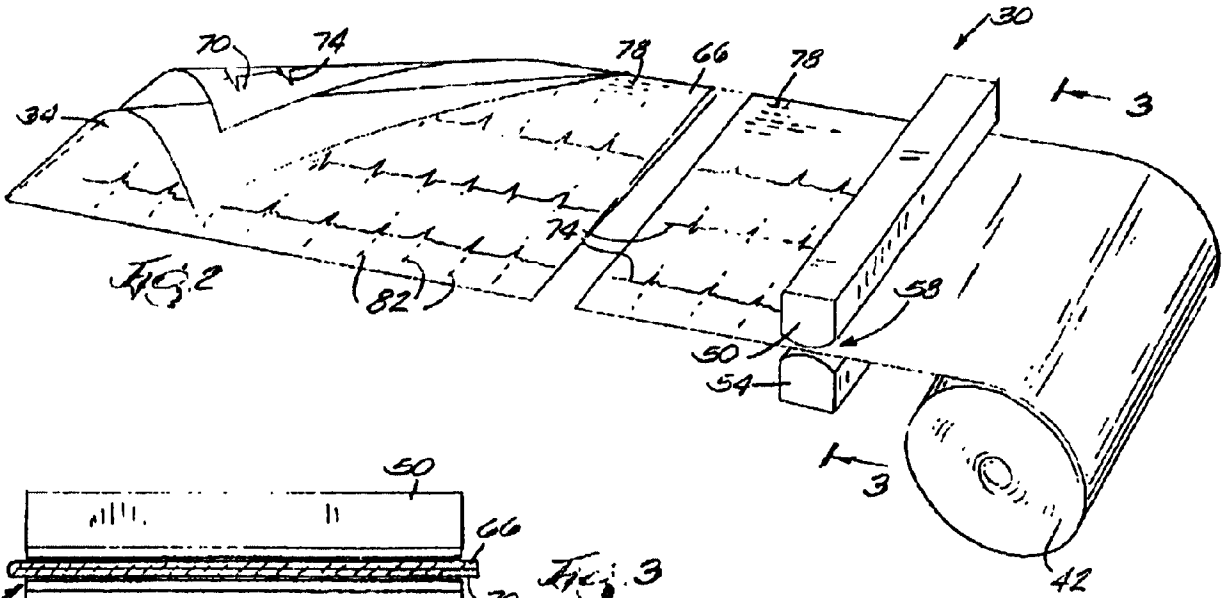
FIG. 2 is a perspective view of a print head arrangement with parts removed for ease of illustration.
Figure 3:
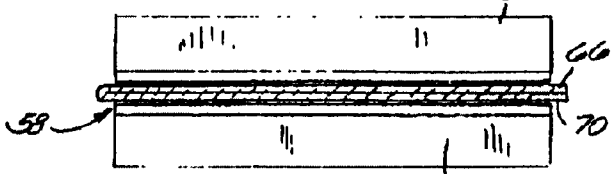
FIG. 3 is a section view taken along line 3—3 of FIG. 2.
Figure 4:
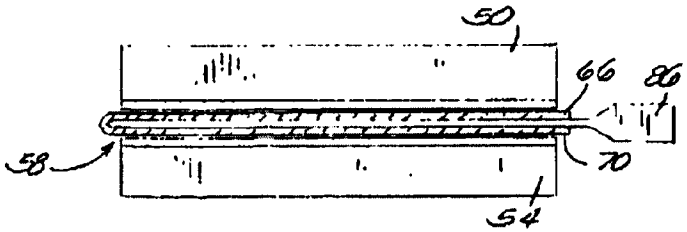
FIG. 4 is a section view similar to FIG. 3 of an alternative embodiment of the invention having a separation member between the print heads.

As best seen in FIGS. 1–3, the paper 34 is folded in half on the roll 42 and defines oppositely facing portions 66 and 70. In the illustrated embodiment, each oppositely facing portion 66 and 70 is between four and six inches wide and is preferably approximately four-and-one-quarter inches wide, so that when the paper 34 is unfolded (see FIG. 1), the printed report is in a standard eight-and-one-half inch wide format. The print heads 50, 54 and the feed path 58, are appropriately sized (approximately four to six inches wide) to accommodate the folded paper 34. As the paper 34 is fed through the feed path 58, the print head 50 prints an image in a first orientation on the first oppositely facing portion 66 and the print head 54 prints an image in a second orientation on the second oppositely facing portion 70. The first and second image orientations are such that when the paper 34 is unfolded, the first and second images have the same orientation, as will be described in more detail below.

While it is not necessary that the printing device 30 print on folded paper 34 as shown, the folded paper 34 provides the advantages discussed above when the printing device 30 is used in conjunction with the ECG device 10 or other medical devices. As described above, the ECG device 10 monitors patient physiological data that is gathered as a function of time. The physiological data is printed on the report in the form of a plurality of printed waveforms 74 (see FIGS. 1 and 2). In addition to the waveforms 74, the patient textual information is also printed on the report in text blocks 78 (see FIGS. 1 and 2). It is to be understood that the number and configuration of waveforms 74 and text blocks 78 shown in the figures are for purposes of illustration only, and can vary according to the specific application and device. As best seen in FIG. 2, the print head 50 prints the text blocks 78 and a plurality of waveforms 74 on the oppositely facing portion 66. At the same time, the print head 54 prints additional waveforms 74 on the oppositely facing portion 70. Of course, the particular information printed by each of the print heads 50, 54 could be reversed so that the print head 54 prints the text blocks 78. This simultaneous double-sided printing allows a complete, standard ECG report to be printed on the oppositely facing portions 66 and 70 in a single pass through the printing device 30. After printing, the paper 34 is unfolded to yield the full ECG report. No extra cutting, tearing, taping, or mounting is required.

The paper 34 preferably includes a background grid 82 (only partially shown in FIGS. 1 and 2) that quantifies the waveforms with respect to time in a "x" or horizontal direction, and magnitude in a "y" or vertical direction. The print heads 50, 54 print on the oppositely facing portions 66, 70 such that the waveforms 74 printed on the portion 66 correlate with the waveforms 74 printed on the portion 70. This correlation is best illustrated in FIG. 1. In FIG. 1, an axis x' is shown with respect to the unfolded paper 34. The axis x' represents one instant in time "t" during which physiological data was gathered by the ECG device 10. Each of the vertically-spaced waveforms 74 is aligned horizontally relative to the axis x' at time "t" such that all data collected during the time "t" is printed on the axis x'. In other words, the waveforms 74 are printed on both the oppositely facing portions 66 and 70 such that all of the waveforms 74 correlate with respect to time.

The waveforms 74 are also correlated with respect to magnitude such that when the paper 34 is unfolded, each of the waveforms 74 depicts a positive change in magnitude in an upward direction (as seen in FIG. 1) and a negative change in magnitude in a downward direction. To achieve this magnitude correlation, it is understood that during printing, the print head 50 prints waveforms 74 in a first orientation (positive magnitude to the right as viewed in FIG. 3) and the print head 54 prints waveforms 74 in an opposite, second orientation (positive magnitude to the left as viewed in FIG. 3).

Because of the heat produced by the opposing print heads 50, 54, it may be helpful to include a separation member 86 (see FIG. 4) positioned in the feed path 58 between the oppositely facing portions 66 and 70. The separation member 86 provides a thermal barrier between the oppositely facing portions 66 and 70 so that heat generated by the print head 50 does not obscure the printed information on the oppositely facing portion 70. Likewise, the separation member 86 prevents heat generated by the print head 54 from obscuring the printed information on the oppositely facing portion 66. The separation member 86 can be made of any suitable material capable of absorbing or dissipating heat. Of course, the separation member 86 need not be used if the printed information on the oppositely facing portions 66 and 70 is not obscured by the opposed print heads 50, 54.

FIG. 5 illustrates an alternative print head configuration wherein the print heads 50' and 54' are laterally offset instead of being directly opposite one another as seen in FIGS. 1–4. The lateral offset may occur due to space constraints within the device 10 or due to the particular configuration of the printing device 30. While not shown, additional backing plates may be needed opposite each print head 50', 54' to maintain contact between the paper 34 and the print heads 50', 54' as the paper passes through the feed path 58'.

In order to obtain the desired time correlation between all of the waveforms 74 when printing with the offset print heads 50', 54', a print delay is used. The print head 50' prints data collected for a given time "t" on the oppositely facing portion 66 before the print head 54' prints the correlating data for the given time "t" on the oppositely facing portion 70. The delay can be controlled by the processor 14 to achieve the properly correlated waveforms 74. Even with the above-described print delay, the full ECG report is still printed in a single pass of the paper 34 through the printing device 30.

FIG. 5 also illustrates an alternative paper feed configuration. As seen in FIG. 5, the paper 34' is fed from a fan-folded stack 90. The stack 90 can be stored inside or outside the device 10. Once again, it is preferred that the paper 34' in the fan-folded stack 90 is folded in half as described above. While not shown, it is understood that the paper 34 can also be supplied in individual folded sheets. It is also worth noting that the printing device 30 could include a folding fixture or guide (not shown) that folds the paper 34 before the paper 34 enters the feed path 58. Such a folding fixture would eliminate the need to supply pre-folded paper from a roll, a fan-folded stack, or an individual sheet. Of course, a folding fixture would likely require additional space, resulting in a less-compact printing device 30.

Regardless of the type of paper supply used, the method of printing the medical data collected by the processor 14 includes passing the folded paper 34 through the feed path 58 such that the first thermal print head 50 prints information (including at least one waveform 74) on the oppositely facing portion 66 and the second thermal print head 54 prints information (including at least one waveform 74) on the oppositely facing portion 70. Both print heads 50, 54 print substantially simultaneously such that a full ECG report is printed in a single pass of the paper 34 through the printing device 30. Even when the offset print heads 50', 54' are used (see FIG. 5), the ECG report is printed during a single pass of the paper 34 through the printing device 30. The printing delay operates to correlate the data with respect to time.

When the paper 34 is unfolded, the waveforms 74 printed on the oppositely facing portions 66, 70 are correlated with each other and with respect to time. The text blocks 78 are also oriented properly with respect to the waveforms 74. The compact printing device 30 thereby generates a ECG report that can be quickly and accurately interpreted by the clinician. The disadvantages of prior art compact printers are overcome by the printing device 30, without sacrificing size or portability.

Other features and advantages of the invention are set forth in the following claims.

What is claimed is:

1. A method of printing, the method comprising:

passing a medium through a printing device; and printing on oppositely facing portions of the medium during a single pass of the medium through the printing device, wherein the medium is folded and wherein the printing on oppositely facing portions is done such that when the folded medium is unfolded, the printed information on one portion of the medium correlates with the printed information on the other portion of the medium.

2. The method of claim 1, wherein the printed information is data, wherein the data is measured with respect to time, and wherein the data on the oppositely facing portions correlate with respect to time.

3. The method of claim 1, wherein the printed information is data, wherein the data is measured with respect to time, and wherein the data on the oppositely facing portions is horizontally aligned with respect to time.

4. The method of claim 1, wherein printing on oppositely facing portions includes printing on one portion with a first print head and printing on the other portion with a second print head.

5. The method of claim 4, wherein printing with the first and second print heads occurs substantially simultaneously.

6. The method of claim 4, wherein the printed information is data, wherein the data is measured with respect to time, and wherein a portion of the data collected in a first measurement time is printed by the first print head before a portion of the data collected in the first measurement time is printed by the second print head, thereby allowing the first and second print heads to be offset from one another in the printing device.

7. The method of claim 1, wherein the printed information is data and wherein the data is medical patient data.

8. The method of claim 1, wherein the printing device includes a thermal print head.

9. A method of printing an image, the image including at least two waveforms corresponding to physiological data collected over time, the method comprising:

passing a folded medium having oppositely facing portions through a printing device;

printing a first waveform on one portion of the folded medium; and printing a second waveform on the other portion of the folded medium, both the first and second waveforms being printed in a single pass of the folded medium through the printing device, wherein the first and second waveforms are printed such that when the folded medium is unfolded, the first and second waveforms are correlated with respect to one another.

10. The method of claim 9, wherein the image further includes textual data and the method further includes printing the textual data on one of the oppositely facing portions of the folded medium.

11. The method of claim 9, wherein the folded medium is fed from a roll.

12. The method of claim 9, wherein the folded medium is fed from a continuous fan-folded stack.

13. The method of claim 9, wherein the first waveform is printed with a first print head and the second wave form is printed with a second print head.

14. The method of claim 13, wherein the first and second print heads are thermal print heads.

15. The method of claim 9, wherein the waveforms correspond to patient medical data.

16. The method of claim 15, wherein the waveforms are generated by a 12-lead ECG unit.

17. A printing device for printing on oppositely facing portions of a medium in a single pass, the printing device comprising:

a feed path for receiving the medium;

a first print head adjacent a first side of the feed path; and a second print head adjacent a second side of the feed path, wherein the medium is folded and the feed path is sized to receive the folded medium, and further wherein the feed path includes a separation member positionable between the oppositely facing portions of the folded medium.

18. The printing device of claim 17, wherein the first print head is configured to print data in a first orientation and the second print head is configured to print data in a second orientation, such that after exiting the print device, the medium can be unfolded and the data printed by the first print head correlates with the data printed by the second print head.

19. The printing device of claim 17, wherein the printing device is coupled to a medical device.

20. A portable medical device comprising:

a processor; and a printing device coupled to the processor for printing patient data collected by the processor, the printing device including:

a feed path for receiving a folded medium having oppositely facing portions;

a first print head adjacent a first side of the feed path for printing data on one portion of the folded medium; and a second print head adjacent a second side of the feed path for printing data on the other portion of the folded medium, wherein the patient data collected by the processor is a function of time, and further wherein the first print head prints data corresponding to a first time period before the second head prints data corresponding to the first time period, so that the first and second print heads can be offset from one another in the printing device.

21. The medical device of claim 20, wherein the first and second print heads of the printing device print substantially simultaneously as the folded medium passes through the feed path.

22. The medical device of claim 20, wherein the feed path is approximately 4 to 6 inches wide.

23. The medical device of claim 22, wherein the folded medium is approximately 4 to 6 inches wide when folded.

24. The medical device of claim 20, wherein the feed path includes a separation member positionable between folded portions of the folded medium.

25. The medical device of claim 20, wherein the first and second print heads are thermal print heads.

26. The medical device of claim 20, wherein the processor is part of a ECG unit.

* * * * *